US007621605B2

(12) United States Patent
Bond et al.

(10) Patent No.: US 7,621,605 B2
(45) Date of Patent: Nov. 24, 2009

(54) SHELF EXTENDING AND LIFTING SYSTEM

(75) Inventors: Steve Bond, Agoura, CA (US); Andrew Tiffin, Thousand Oaks, CA (US)

(73) Assignee: Easy Lift LLC, Thousand Oaks, CA (US)

( * ) Notice: Subject to any disclaimer, the term of this patent is extended or adjusted under 35 U.S.C. 154(b) by 573 days.

(21) Appl. No.: 11/584,299

(22) Filed: Oct. 19, 2006

(65) Prior Publication Data

US 2007/0035220 A1 Feb. 15, 2007

Related U.S. Application Data

(63) Continuation-in-part of application No. 10/956,962, filed on Sep. 30, 2004, now abandoned.

(51) Int. Cl.
*A47B 88/00* (2006.01)

(52) U.S. Cl. ..... 312/325; 312/319.5; 312/311; 414/917

(58) Field of Classification Search ..... 312/294, 312/309, 310, 311, 319.1, 319.2, 319.3, 319.5, 312/319.7, 321, 325, 330.1, 334.2, 410, 228.1; 211/126.15, 41.4, 41.8; 134/135, 133; 474/4, 474/84, 148; 254/389, 393, 394; 414/DIG. 917; 74/89.2, 89.22
See application file for complete search history.

(56) References Cited

U.S. PATENT DOCUMENTS 1,283,513 A 11/1918 Heyward
2,590,341 A * 3/1952 Nabholz ..... 312/266
2,919,966 A * 1/1960 Preston ..... 312/27
3,195,969 A 7/1965 Wallen
4,095,422 A * 6/1978 Kurakake ..... 60/398
4,893,885 A * 1/1990 Borello ..... 312/249.9
4,915,461 A * 4/1990 Kingsborough et al. ..... 312/247
5,249,858 A 10/1993 Nusser
5,308,158 A 5/1994 Vogelgesang et al.
5,595,200 A * 1/1997 Favaro ..... 134/201
5,996,723 A * 12/1999 Shimizu et al. ..... 180/444
6,073,624 A 6/2000 Laurent
6,247,771 B1 * 6/2001 Miller ..... 312/310
6,510,858 B1 * 1/2003 Halstead et al. ..... 134/57 D
6,755,490 B2 * 6/2004 Welch et al. ..... 312/228.1
6,991,199 B2 * 1/2006 Carpentier ..... 248/122.1
7,410,228 B2 * 8/2008 Dickson et al. ..... 312/311
2004/0163687 A1 * 8/2004 Son et al. ..... 134/58 D (Continued)

*Primary Examiner*—Lanna Mai
*Assistant Examiner*—Michael Calabrese
(74) *Attorney, Agent, or Firm*—Koppel, Patrick, Heybl & Dawson

(57) ABSTRACT

A cabinet having opposing side walls and an open, or openable, frontal area, provides a pair of arms pivotally engaged with each of the side walls. The arms are rotatable between a downwardly and rearwardly directed position and a forwardly directed position extensive of the frontal area for exposing a shelf or basket. Each of the pair of arms is engaged with slots in a guide plate fixed at one side of the shelf or basket, whereby the basket is driven linearly, by the arms, between a retracted position inside the cabinet to a frontal position, while the arms traverse the slots, and then the arms lift the basket in an arc to an extended and raised convenient height. Such movement is facilitated by a motor driven linear actuator or by pulleys rotated by drive cords or belts.

15 Claims, 9 Drawing Sheets

U.S. PATENT DOCUMENTS

2005/0206282 A1* 9/2005 Walburn ..... 312/312
2008/0129168 A1* 6/2008 Banta et al. ..... 312/333
2008/0272072 A1* 11/2008 Tynes et al. ..... 211/41.8

* cited by examiner

SHELF EXTENDING AND LIFTING SYSTEM

CROSS-REFERENCE TO RELATED APPLICATIONS

This is a continuation-in-part application of U.S. patent application Ser. No. 10/956,962, filed Sep. 30, 2004 now abandoned and which is pending at the time of this filing.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTTED ON A COMPACT DISC

Not applicable.

REFERENCE TO A "MICROFICHE APPENDIX"

Not applicable.

BACKGROUND OF THE INVENTION

1. Field of the Present Disclosure

This disclosure relates generally to dishwasher appliances and similar apparatuses and more particularly to such apparatuses with mechanized shelf-raising and lowering capability.

2. Description of Related Art including information disclosed under 37 CFR 1.97 and 1.98

Laurent, U.S. Pat. No. 6,073,624, A swing-out supporting arrangement primarily intended for a wall-mounted oven of domestic type comprises a bottom plate supported by link arms, said bottom plate and an insert, possibly associated with said bottom plate, being retractable from the oven by a swing-out movement without the use of any front door. The bottom plate with the insert can be moved between a first position inside the oven and a second swing-out position below and in front of the over front wall. Preferably, the swing-out movement is performed by means of an electric motor which is rotatable between two end positions. The principle of invention can also be used for a ceiling plate supported by link arms, said plate being swingingly displaced in a corresponding lifting movement from an oven positioned at a low level.

Vogelgesang et al, U.S. Pat. No. 5,308,158 describes a pull down shelf assembly for facilitating access to upper storage shelves. The shelf assembly includes a shelf guide track mechanism and the storage shelf slidably mounted for movement between an extended position and a retracted position. A pantographic pull down mounting assembly coupled between a shelf mounting bracket and the track mechanism produces pantographic movement thereof between a deployed position, for increased access, and an elevated stored position. The pantographic assembly is mounted therebetween at locations producing near-horizontal pantographic movement of the track mechanism with the storage shelf carried thereby throughout an arcuate path between the deployed position and the elevated stored position. A spring biasing mechanism coupled between the mounting bracket and one of the arms biases the track mechanism toward the stored position. A shelf locking mechanism, positioned between the track mechanism and the storage shelf, locks the storage shelf in the extended position during movement of the track mechanism from the deployed position to the elevated stored position.

Nusser, U.S. Pat. No. 5,249,858, discloses a motor driven movable cabinet that provides top shelf accessibility by being lowered outwardly onto the underlying counter top and retracted back to its original position against the wall. A motor driven threaded screw lifting mechanism powers the cabinet's movement and consists of a reversible electric motor and a drive shaft assembly, including a drive shaft and a threaded screw drive rod. The motor is attached to the drive shaft assembly by a universal joint and a load bearing bracket pivot assembly. This motorized mechanism is then fastened to a wall frame that is secured to the wall behind the cabinet. The cabinet is also attached to the wall frame by at least four L-shaped swing arms and to the motorized mechanism by a pivot mount bracket hingedly attached to the bottom of the cabinet. The pivot assembly supports the drive shaft assembly and the universal joint allows for a change in the angle from the pivot assembly along the drive shaft and threaded screw drive rod to the bottom of the cabinet. The actual raising and lowering operations result when the motor rotates the drive shaft causing the rod to shorten as it screws up into the shaft thereby raising the cabinet. The cabinet is lowered when the threaded screw rod lengthens by unscrewing from the drive shaft. At least four L-shaped swing arms assist the motored mechanism in moving the cabinet by maintaining the cabinet's parallel position to the wall.

Wallen, U.S. Pat. No. 3,195,969, discloses a dishwasher with front top opening, and movable supports for guiding movement of the support first vertically and then outwardly for access through the top opening.

Heyward, U.S. Pat. No. 1,283,513, discloses a typewriter desk with side flanges of a desk top slotted so that the desk top may by quickly and easily removed.

The related art described above discloses apparatuses with moving shelves, however, the prior art fails to disclose a means for moving a shelf linearly and then in an arc from a rearward lower position to an extended upper position using slots enabling the application of only horizontal forces, followed by lifting forces in a simplified apparatus. The present disclosure distinguishes over the prior art providing heretofore unknown advantages as described in the following summary.

BRIEF SUMMARY OF THE INVENTION

This disclosure teaches certain benefits in construction and use which give rise to the objectives described below.

The present invention is generally used for kitchen cabinets, dishwashers and the like. Specifically, the invention is an appliance lifting system that raises a lower shelf or under-counter cabinet up to the counter level with the intention of making it easy for a user to load and unload the shelf, or in the case of a dishwasher, a basket. The system is directed to the lower shelves of cabinets or generally, shelves that require a user to bend or stoop down to load or unload. The system comprises two set of elongated levers or arms, each set arranged in a parallelogram configuration fastened on one end to a cabinet sidewall and on the other end to the lower cabinet shelf or basket. The arms in each set are connected to one another by a combination of pivot pins and pin and slot sliding connections in the primary embodiment. The system operates in two phase motion. During the first phase, the system linearly and horizontally slides the shelf out of the cabinet. In the second phase, the system raises the shelf in an arcuate motion out and upwards to counter level. In use the operation of the system may be by manual pushing or pulling of the shelf with spring assist, or by motor driven arms that accomplish the intended motion automatically. The later approach is considered to be the preferred embodiment and will be described in detail below.

A primary objective of the present invention is to provide an apparatus and method of use of such apparatus that yields advantages not taught by the prior art.

Another objective of the invention is to provide a mechanized system to raise and lower a shelf or basket to the level of a counter for ease of loading or unloading articles therein.

A further objective of the invention is to enable such a mechanized system with a limited number of parts so as to achieve practical cost effectiveness in a finished product.

A still further objective of the invention is to enable such a mechanized system that is able to provide both shelf extension and shelf raising and lowering using a single set or pair of actuators and mechanical engagements.

Other features and advantages of the embodiments of the present invention will become apparent from the following more detailed description, taken in conjunction with the accompanying drawings, which illustrate, by way of example, the principles of at least one of the possible embodiments of the invention.

BRIEF DESCRIPTION OF THE SEVERAL VIEWS OF THE DRAWING(S)

The accompanying drawings illustrate at least one of the best mode embodiments of the present invention. In such drawings.

DETAILED DESCRIPTION OF THE INVENTION

Figure 1:
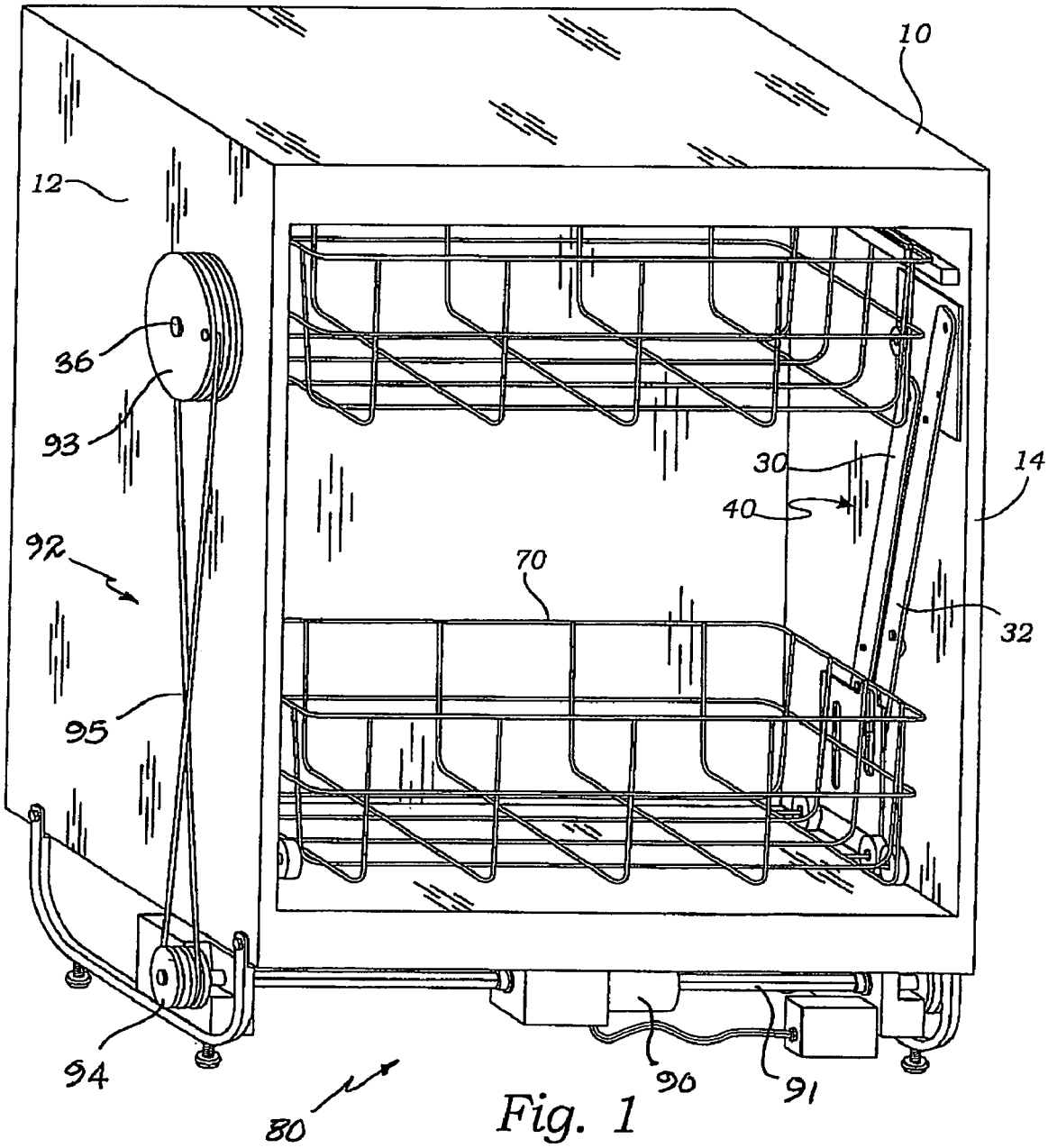
FIG. 1 is a perspective view of a preferred embodiment of the invention showing a basket of the invention in a retracted position.

The above described drawing figures illustrate the present invention in at least one of its preferred, best mode embodiments, which is further defined in detail in the following description. Those having ordinary skill in the art may be able to make alterations and modifications in the present invention without departing from its spirit and scope. Therefore, it must be understood that the illustrated embodiments have been set forth only for the purposes of example and that they should not be taken as limiting the invention as defined in the following.

The present invention includes a cabinet 10 housing a basket 70 such as is found in commercial dishwashers. The cabinet 10 has opposing side walls 12 and 14 as shown in the figures. Clearly, such a cabinet preferably also has a top, back and bottom panels, and a door 11 as shown. Numeral 20 in FIG. 8 identifies an open frontal area of cabinet 10. Two pairs of arms 30 and 32 are mounted within cabinet 10 one pair on each side of the cabinet 10. As shown in FIG. 3, a proximal end 34 of one of the arms 32 of each of the pairs of arms is engaged with a rotatable axle 36 which is supported by the opposing side walls 12 and 14, thereby enabling the arms 30 and 32 to rotate between a downward, rearwardly directed position 40 (FIGS. 1, 3 and 6) within the cabinet 10, and a forward, raised position 50 (FIGS. 5, 8 and 9), extensive of the open frontal area 20. Distal ends 35 of the arms 30 and 32 are pivotally engaged within elongate closed slots 62 and 64 in the basket 70; wherein the slots 62 and 64, and arms 30, 32 are arranged to move the basket 70 linearly between the rearward, lowered position shown in FIGS. 1 and 3, and a forward, lowered position shown in FIGS. 2 and 7 as the arms 30 and 32 traverse the elongate slots 62 and 64 respectively, and without raising the basket vertically. As the arms 30 and 32 continue in the forward direction, they raise the basket 70 vertically in arcuate rotation into the extended, raised position which is at least partially forward of the open frontal area 20. The arms 30, 32 move between the downwardly, rearwardly directed position 40 within the cabinet 10, and the forwardly directed, raised position 50 extensive of the open frontal area 20 to achieve the above described movement of basket 70. In order to accomplish the movement of arms 30, 32 as described above, an electric drive system 80 is employed, as will be described.

Figure 5:
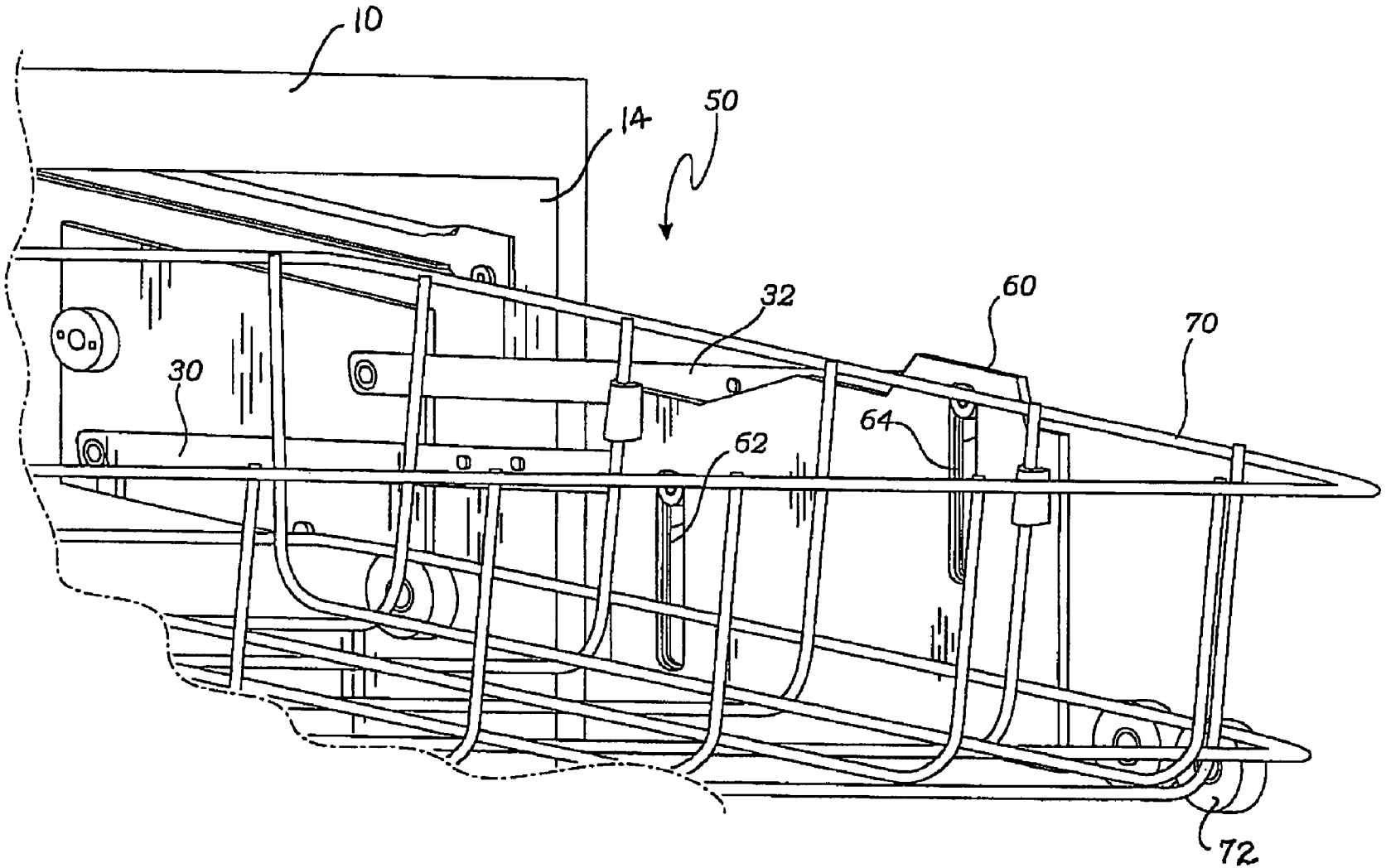
FIG. 5 is an partial enlarged perspective view thereof showing details of the lifting arms with the basket in the raised position.
Figure 6:
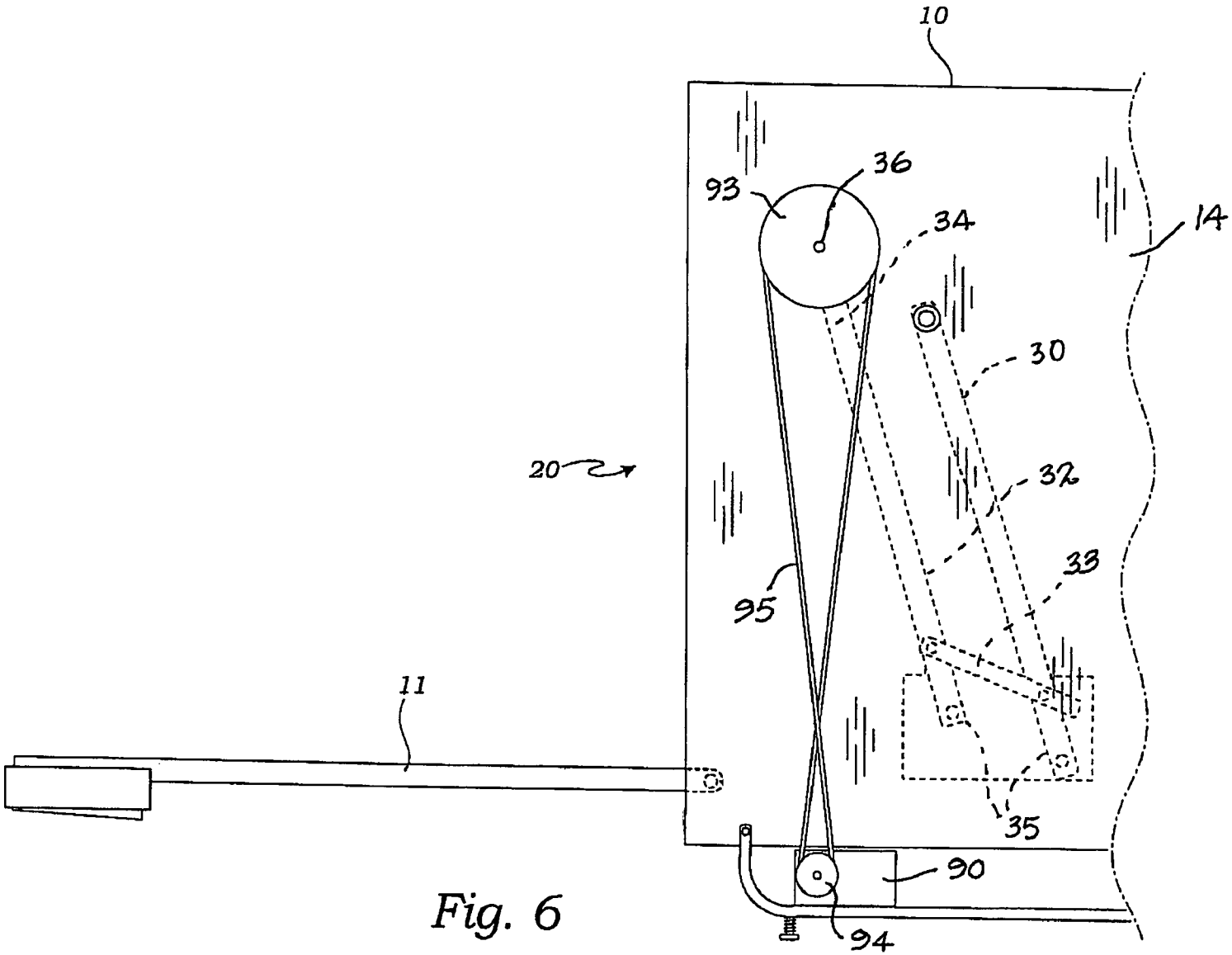
FIGS. 6-8 are side elevational views thereof showing a door of the apparatus in a folded down position and a pulley drive lifting mechanism of the invention with basket retracted, forward and raised respectively.
Figure 8:
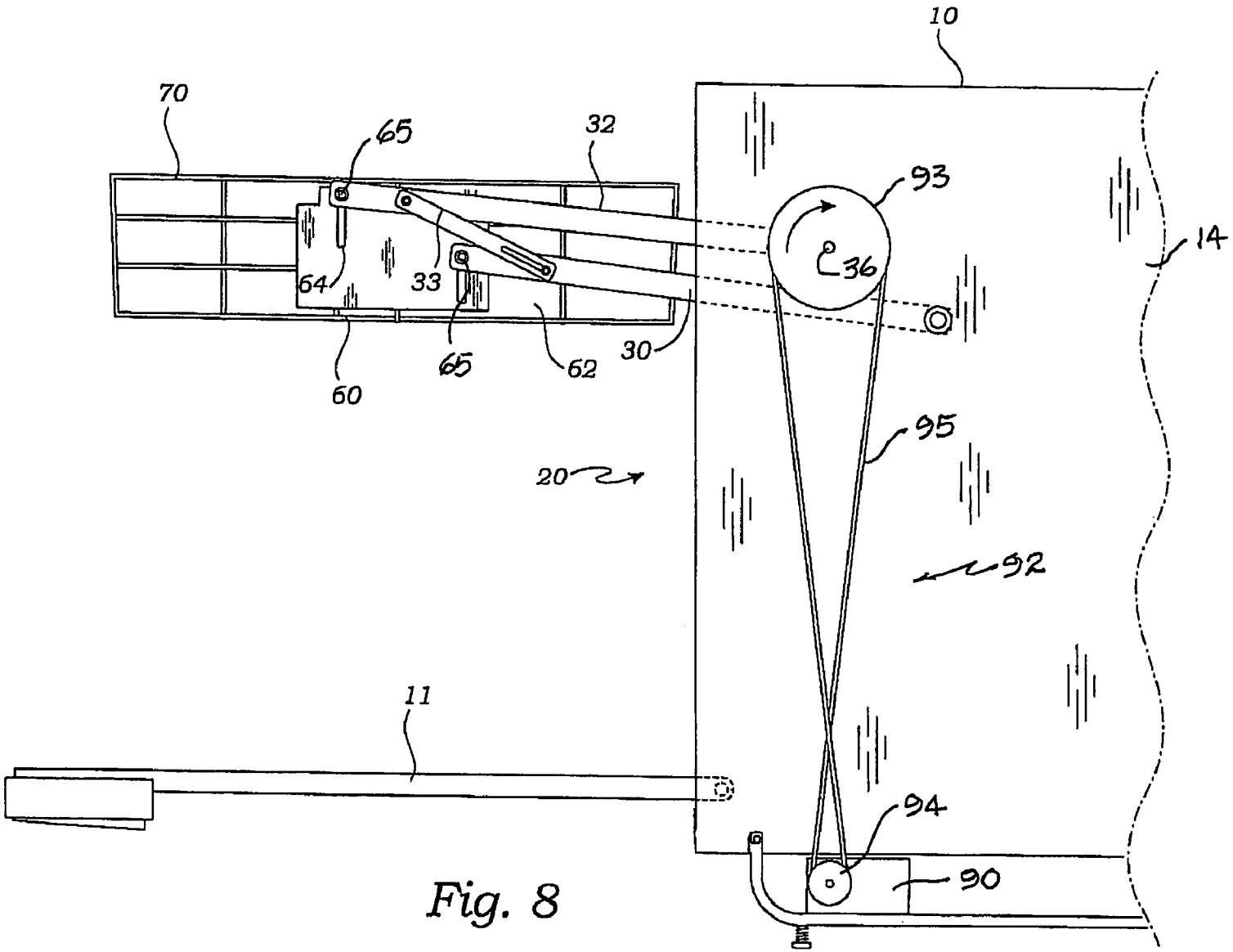

It is noted, that when the arms 30, 32 are moved to the raised position 50, as shown in FIGS. 5 and 8, the basket 70 is preferably raised to the level of a typical counter top so as to be in position for loading and unloading without having to stoop or bend over.

As shown then, basket 70 is able to move by rolling on wheels 72, between positions 40 and 45 by force exerted by arms 30 and 32. This linear horizontal motion of the basket 70 is accomplished without lifting forces because the distal ends 35 of arms 30 and 32 slide within closed slots 62 and 64 on wheels or glides 65.

The use of the term "basket" herein shall also include and refer to shelves, trays and other types of article holding or storing devices. While the term "basket" is commonly used to describe a shelf in a dishwasher apparatus, it is noted here that the invention is not limited to such apparatuses.

Figure 4:
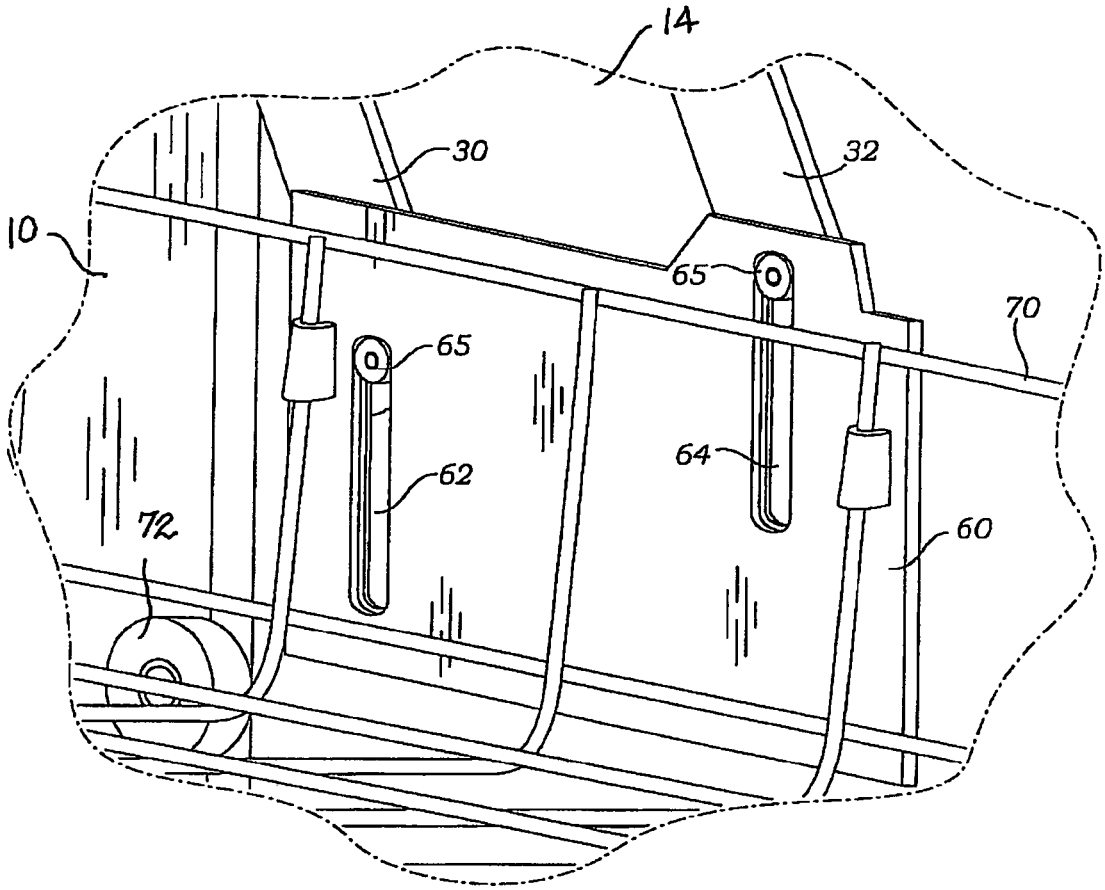
FIG. 4 is a partial enlarged view thereof showing details of a basket guide plate of the invention.

The arms 30 and 32 of each of the pairs of arms are preferably pivotally interconnected by a strut 33, the strut acting to stabilize the arms 30 and 32 and maintain them in parallel alignment, as they move over their course of motion. Preferably, guide plates 60 (part of basket 70) each provide the slots 62 and 64, whereby the arms 30 and 32, at their distal ends 35, are adapted for being captured for sliding motion in slots 62 and 64 respectively as best seen in FIG. 4. Such adaptation preferably includes rollers 65, as previously stated, which are able to move in the slots 62, 64 with near frictionless sliding and/or roller motion.

In a preferred embodiment, the electric drive system 80 comprises a motor 90 engaged with a drive pulley system 92 for rotating the axles 36 in first and second rotational senses, i.e., clockwise and counterclockwise rotation. The drive pulley system 92 preferably includes a pair of follower pulleys 93, wherein, each of the follower pulleys 93 is engaged with one of the axles 36. The drive pulley system 92 further includes a pair of drive pulleys 94, where, each of the drive pulleys 94 is engaged with the motor 90 by shaft 91. Each of the follower and drive pulleys 93 and 94 respectively, are joined by two flexible cables 95' and 95" for transmitting rotational force from the motor 90 to the axles 36 in their opposing rotational directions.

Figure 2:
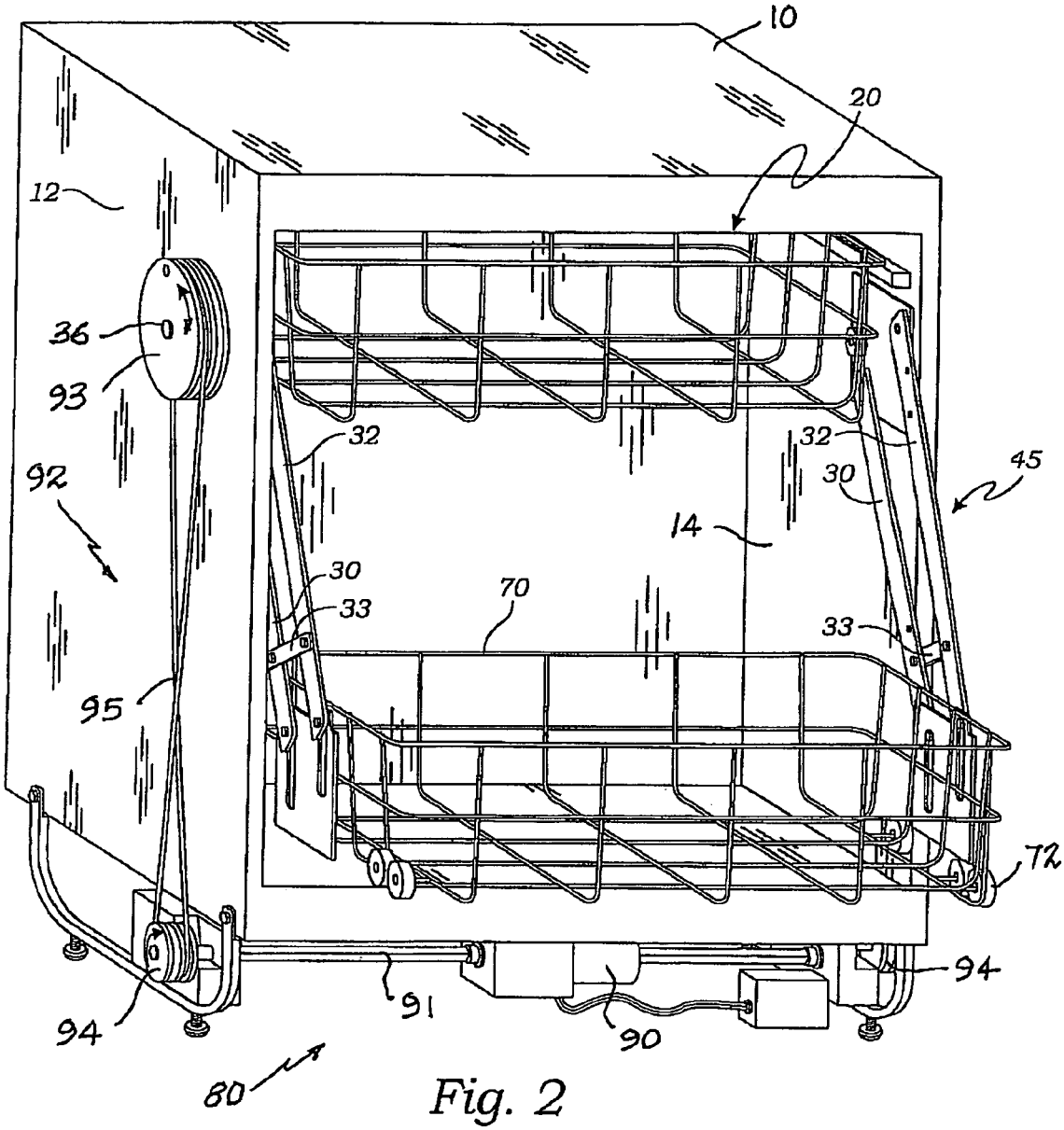
FIG. 2 is the same view as FIG. 1 but showing the basket in an extended lowered position.
Figure 3:
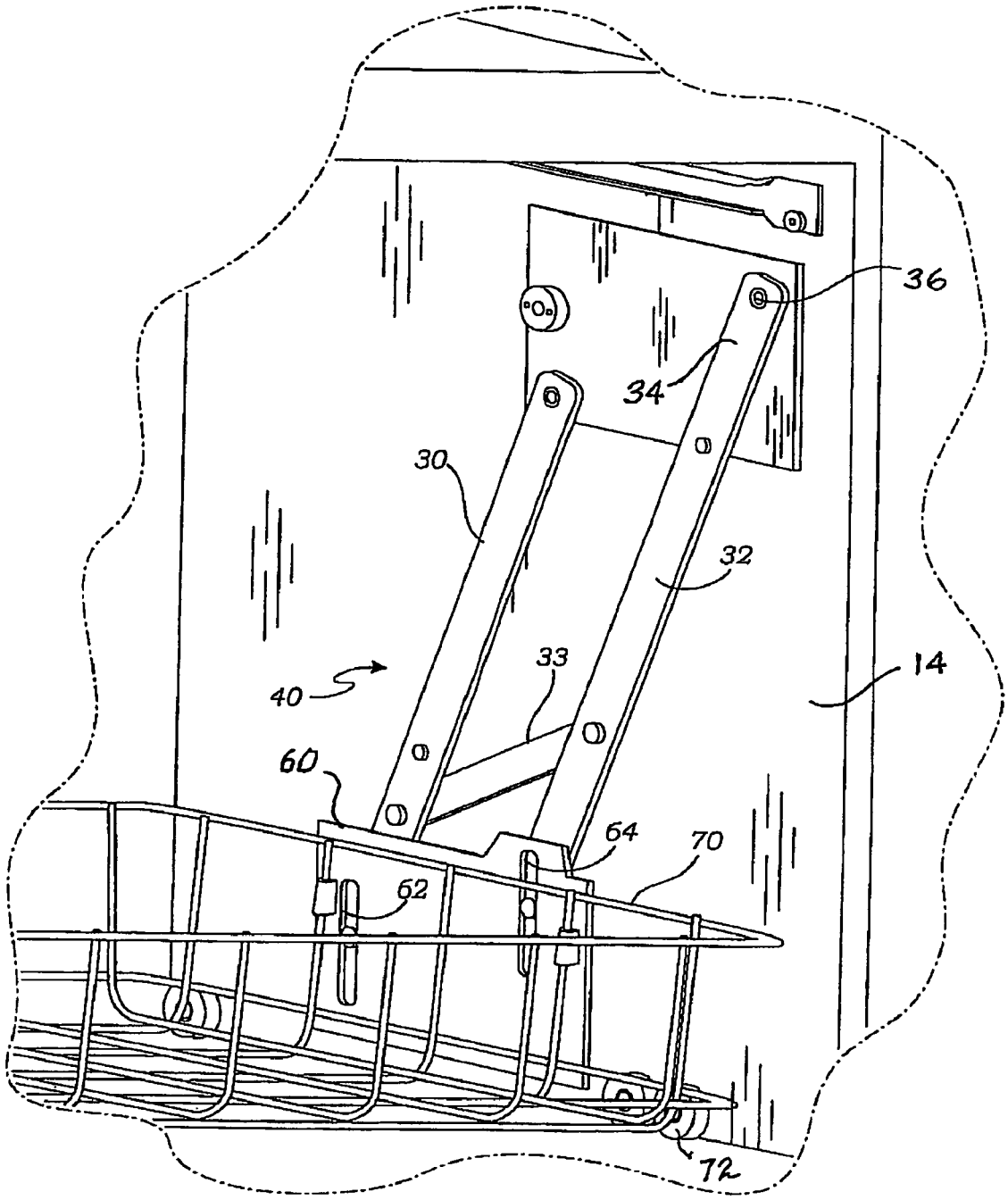
FIG. 3 is a partial enlarged view thereof, showing details of lifting arms of the invention.
Figure 7:
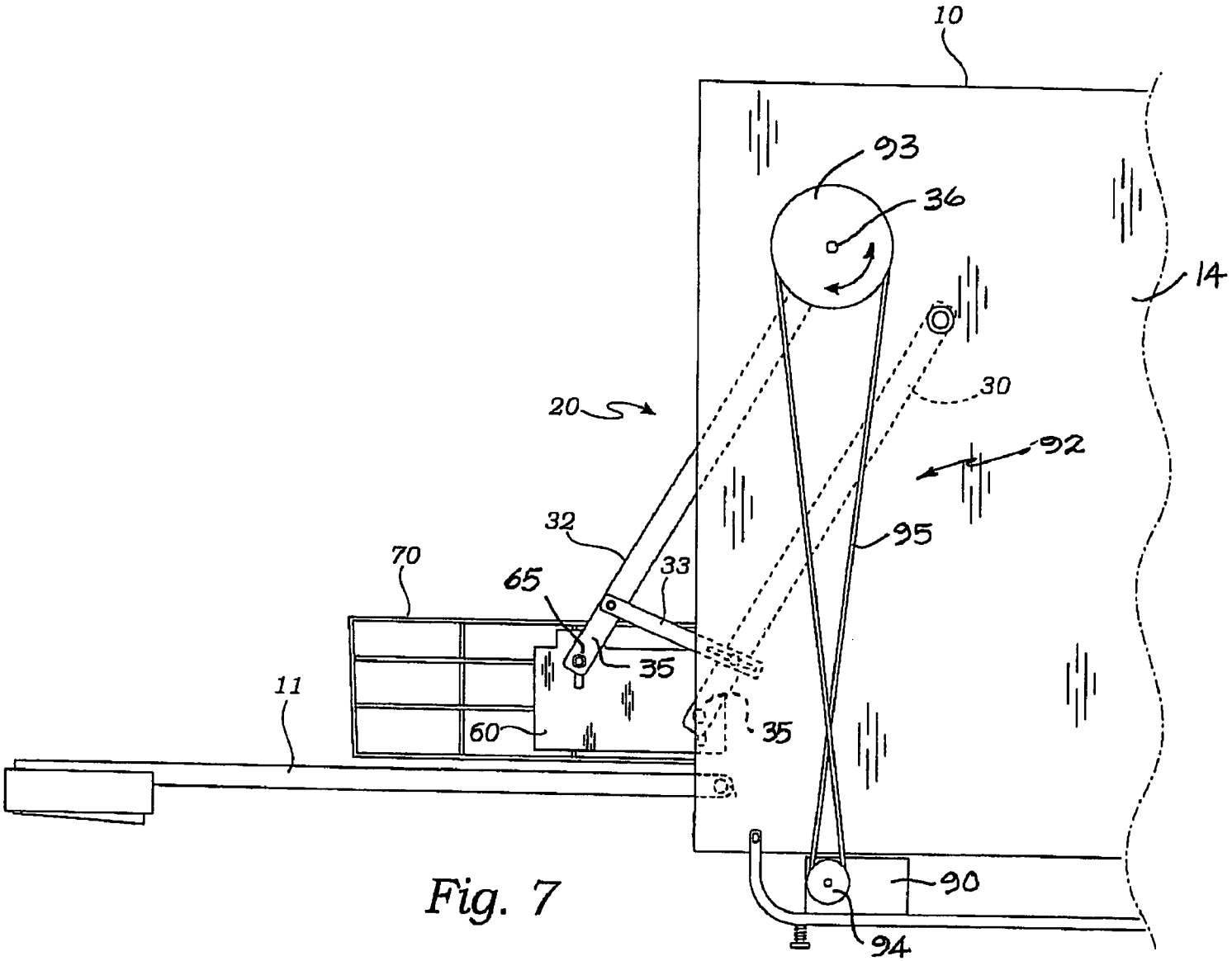

Preferably, in this embodiment, the motor 90 is positioned below a bottom panel of the dishwasher as shown in FIGS. 1 and 2 and drive shafts 91 join the motor 90 with the lower drive pulleys 94 which are positioned exterior to side walls 12 and 14. Preferably, cables 95' and 95" are mounted between pulleys 93 and 94 on each side of cabinet 10. These two cables 95' and 95", on each side are wound in opposite directions so that so that they act in a push-pull fashion, as one cable is winding, the other cable is unwinding. At any time in the retraction/lowering and extension/lifting of basket 70, only one of the two cables 95' and 95" is in tension, one (95') for driving the basket 70 out, as shown in FIG. 7, and then lifting it, as shown in FIG. 8; and one (95") for lowering the basket 70 and then driving it back into the cabinet 10. By using two cables 95' and 95", the need for more expensive and elaborate drive belts and pulleys is avoided, and the cables need not remain in constant tension. Also, the use of cables that reach their ends, thereby preventing further rotation, when the basket 70 has achieved its terminal positions, enables the motor 90 to be shut down at the end of each half cycle by a simple, cost saving, over-current sensor controlling a solid state relay or by a similar mechanism.

Figure 9:
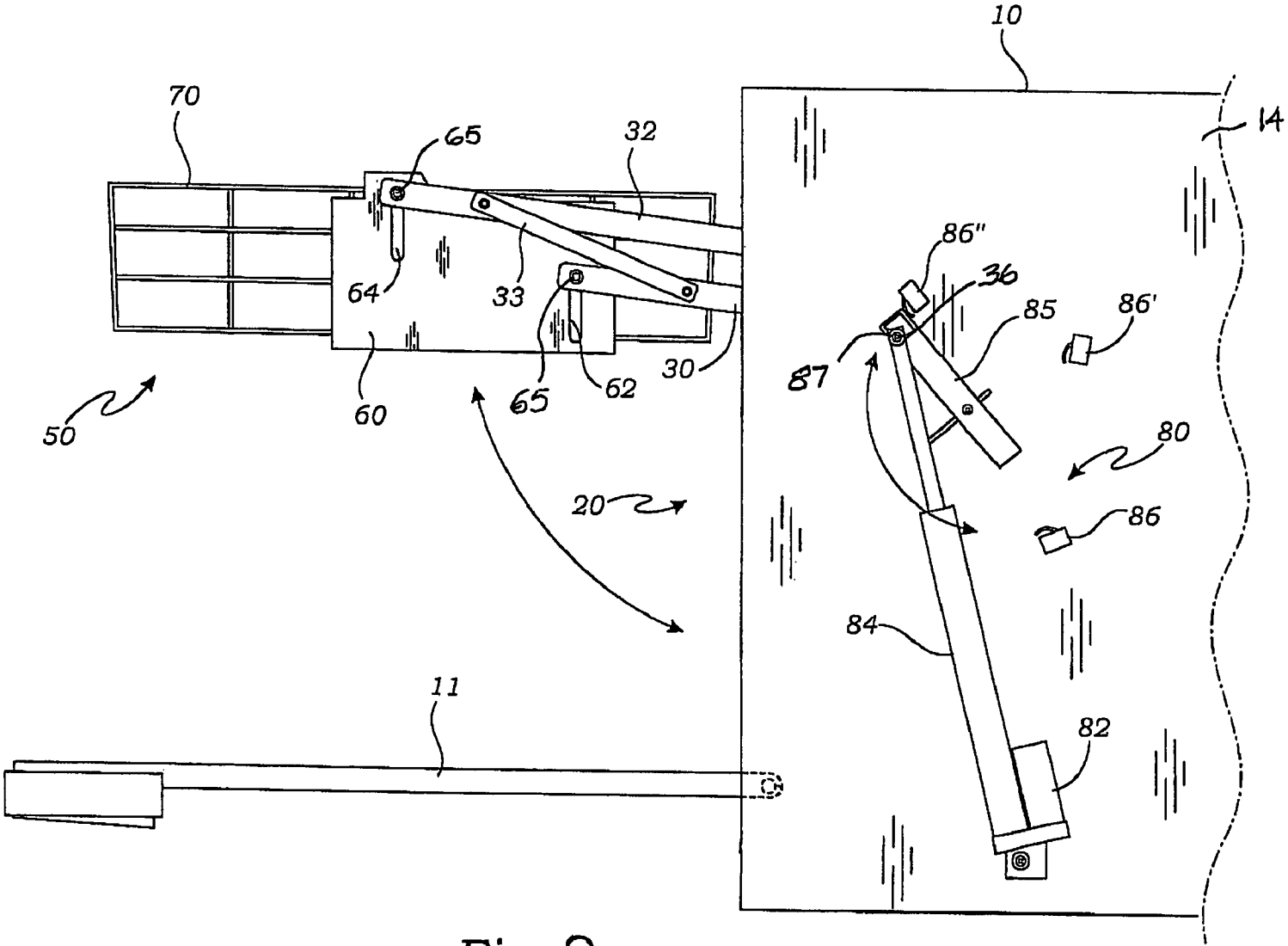
FIG. 9 is a side elevational view of an alternate lifting mechanism.

In an alternate embodiment, shown in FIG. 9, the electric drive system 80 is preferably a motor 82, such as a small electric gear-motor with a linearly extensible strut 84 such as a worm gear linear actuator, well known in the art. The drive system 80, preferably includes limit switches 86, 86' and 86" positioned for disengaging power to the drive system 80 when in position 40, as shown in FIG. 1, and in the extended 45 and raised position 50, as shown in FIGS. 3 and 9 respectively. The simple electrical circuit necessary for controlling the drive system 80 in this configuration would be configured easily by those of skill in the art and may, for instance, be adapted to move the arms 30 and 32 between positions 40 and 50 without stopping at position 45, or between positions 40 and 45 independently of moving between positions 45 and 50. Clearly, to enable such, limit switches 86, 86' and 86" are positioned for actuation when the drive system 80 has attained any one of the positions 40, 45 and 50 respectively. As shown in FIG. 9, leverage bar 85 is pivotally joined to extensible strut 84 at its distal end so as to provide torque leverage to pivot 87 interconnected with arm 32. The electric drive system 80 is configured in mirror image on both sides of cabinet 10 so that the opposing arms 32 on both sides are driven simultaneously for uniform motion actuation of basket 70.

The enablements described in detail above are considered novel over the prior art of record and are considered critical to the operation of at least one aspect of one best mode embodiment of the instant invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or elements of the embodiments of the herein described invention and its related embodiments not described are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments or that a single element may be substituted for two or more elements in a claim.

Changes from the claimed subject matter as viewed by a person with ordinary skill in the art, now known or later devised, are expressly contemplated as being equivalents within the scope of the invention and its various embodiments. Therefore, obvious substitutions now or later known to one with ordinary skill in the art are defined to be within the scope of the defined elements. The invention and its various embodiments are thus to be understood to include what is specifically illustrated and described above, what is conceptually equivalent, what can be obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. An apparatus comprising: a cabinet providing opposing side walls; rotatable axles supported by the side walls; arms extending between the axles and a basket; the axles rotatable to move the arms and basket between a lowered position within the cabinet, and a raised position forward of the cabinet; a drive system having a motor rotationally engaged with a pair of drive pulleys positioned adjacent the side walls; the drive pulleys engaged with a pair of follower pulleys each secured to, and rotational with one of the axles; a pair of drive cables engaged between each one of the drive and follower pulleys in an arrangement wherein one of the drive cables of each said pair of the drive cables on each side of the cabinet is interconnected so as to move one of the arms and the basket from the lowered position to the raised position, the drive pulleys rotating the follower pulleys in a first rotational sense, and the other of the cables of each said pair of the cables on each side of the cabinet is interconnected so as to move the basket from the raised position to the lowered position, the drive pulleys rotating the follower pulleys in a second rotational sense.

2. The apparatus of claim 1 wherein the arms between the axles and the basket on each side of the cabinet comprise a pair of parallel arms pivotally interconnected by a strut.

3. The apparatus of claim 1 wherein each of the drive pulleys and each of the follower pulleys provide plural grooves engaged with plural turns of the drive cables.

4. The apparatus of claim 3 wherein terminal ends of the drive cables are pinned to the pulleys wherein when one of the cables of each of the pairs of cables is fully wound onto one of the pulleys, the other one of the cables of each of the pairs of cables is fully played out from the one of the pulleys.

5. The apparatus of claim 1 wherein the basket has dual parallel slots therein on each of two opposing sides of the basket, the arms slidingly engaged within the slots with a range of sliding motion enabling the arms to move the basket horizontally between a fully engaged position within the cabinet and a position extended outwardly from the cabinet without raising the basket vertically.

6. An apparatus comprising: a cabinet providing opposing side walls; rotatable axles supported by the side walls; arms extending between the axles and a basket; the axles rotatable to move the arms and basket between a lowered position within the cabinet, and a raised position forward of the cabinet; a drive system having a motor rotationally engaged with a pair of drive pulleys positioned adjacent the side walls and axially aligned with the motor; the drive pulleys engaged with a pair of follower pulleys, wherein each of the follower pulleys is axially secured to, and rotational with one of the axles; a pair of drive cables engaged between each one of the drive and follower pulleys in a push-pull arrangement wherein one of the drive cables of each said pair of the drive cables is interconnected to rotate one of the arms and the basket between the lowered position and the raised position.

7. The apparatus of claim 6 wherein the arms between the axles and the basket on each side of the cabinet comprise a pair of parallel arms pivotally interconnected by a strut.

8. The apparatus of claim 6 wherein each of the drive pulleys and each of the follower pulleys provide plural grooves engaged with plural turns of the drive cables.

9. The apparatus of claim 8 wherein terminal ends of the drive cables are pinned to the pulleys wherein when one of the cables of each of the pairs of cables is fully wound onto one of the pulleys, the other one of the cables of each of the pairs of cables is fully played out from the one of the pulleys.

10. The apparatus of claim 6 wherein the basket has dual parallel slots therein on each of two opposing sides of the basket, the arms slidingly engaged within the slots with a range of sliding motion enabling the arms to move the basket horizontally between a fully engaged position within the cabinet and a position extended outwardly from the cabinet without raising the basket vertically.

11. An apparatus comprising: a cabinet providing opposing side walls; a pair of rotatable axles supported by the side walls; the pair of rotatable axles each engaged with arms extending between the axles and a basket, the arms rotatable with the axles to move the arms and basket between a lowered position and a raised position; a drive system having a motor rotationally engaged with a pair of drive pulleys, the drive pulleys engaged with follower pulleys, the follower pulleys axially rotational with the axles; a pair of drive cables engaged between each one of the drive and follower pulleys in a push-pull arrangement wherein the drive cables rotate the arms and the basket between the lowered position and the raised position.

12. The apparatus of claim 11 wherein the arms between the axles and the basket comprise two pair of parallel arms each pivotally interconnected by a strut.

13. The apparatus of claim 11 wherein each of the drive pulleys and each of the follower pulleys provides plural grooves engagable with plural turns of the drive cables.

14. The apparatus of claim 13 wherein terminal ends of the drive cables are pinned to the pulleys wherein when one of the cables of each of the pairs of cables is fully wound onto one of the pulleys, the other one of the cables of each of the pairs of cables is fully played out from the one of the pulleys.

15. The apparatus of claim 11 wherein the basket has dual parallel slots therein on each of two opposing sides of the basket, the arms slidingly engaged within the slots with a range of sliding motion enabling the arms to move the basket horizontally between a fully engaged position within the cabinet and a position extended outwardly from the cabinet without raising the basket vertically.

* * * * *